US007137331B2

(12) United States Patent
Dohgami et al.

(10) Patent No.: US 7,137,331 B2
(45) Date of Patent: Nov. 21, 2006

(54) HYDRAULIC CYLINDER DEVICE

(75) Inventors: Masaki Dohgami, Kani-gun (JP); Dwight Bruce Stephenson, Delafield, WI (US)

(73) Assignees: Husco International, Inc., Waukesha, WI (US); Kayaba Industry Co., Ltd., Tokyo (JP)

( * ) Notice: Subject to any disclaimer, the term of this patent is extended or adjusted under 35 U.S.C. 154(b) by 33 days.

(21) Appl. No.: 10/528,859

(22) PCT Filed: Mar. 26, 2004

(86) PCT No.: PCT/JP2004/004280

§ 371 (c)(1),
(2), (4) Date: Mar. 23, 2005

(87) PCT Pub. No.: WO2004/085859

PCT Pub. Date: Oct. 7, 2004

(65) Prior Publication Data

US 2006/0162545 A1 Jul. 27, 2006

(30) Foreign Application Priority Data

Mar. 26, 2003 (JP) ..... 2003-084903

(51) Int. Cl.
*F15B 11/00* (2006.01)

(52) U.S. Cl. ..... 91/533

(58) Field of Classification Search ..... 91/533, 91/534

See application file for complete search history.

(56) References Cited

U.S. PATENT DOCUMENTS 1,195,980 A * 8/1916 Davis ..... 91/533

FOREIGN PATENT DOCUMENTS

JP 2001099356 A * 4/2001
JP 2000-205999 1/2002

* cited by examiner

*Primary Examiner*—Edward K. Look
*Assistant Examiner*—Michael Leslie
(74) *Attorney, Agent, or Firm*—George E. Haas; Quarles & Brady LLP

(57) ABSTRACT

A pair of hydraulic cylinders 10 which are coupled to a driven member, placed parallel to each other and extend/contract in synchronization with each other, and a control valve 20 which controls hydraulic fluid supplied to or discharged from the hydraulic cylinder 10 are provided. An elastic support mechanism 50 which supports the control valve 20 to each hydraulic cylinder between the paired hydraulic cylinders 10; metallic piping 30 and the metallic piping 40 which connect the control valve 20 with the respective hydraulic cylinders 10 and leads the hydraulic fluid controlled by the controlling valve 20; and curved portions 31*c*, 32, 41*c*, 42*a* which are provided at some midpoints of the piping and flexibly deform in accordance with relative deformation of each hydraulic cylinder 10 are provided. A difference in relative displacement of each hydraulic cylinder with respect to the control valve 20 is absorbed by deformation produced in the elastic support mechanism 50 and the curved portions.

7 Claims, 8 Drawing Sheets

HYDRAULIC CYLINDER DEVICE

FIELD OF THE INVENTION

This invention relates to an improvement in a hydraulic cylinder apparatus for driving a boom of heavy-duty machinery for construction, for example.

RELATED ART

Conventionally, for example, as disclosed in Japanese unexamined patent publication 2002-21114, such a type of hydraulic cylinder apparatus is structured such that a hydraulic cylinder is connected to a flexible hose or the like provided for supplying and discharging hydraulic fluid and the flexible hose extends along a boom of the heavy-duty machine/vehicle or the like in such a way as to be movable in accordance with the movement of the boom or the like.

However, in such a hydraulic cylinder apparatus, if the flexible hose for supplying the hydraulic fluid to the hydraulic cylinder is damaged, leakage of the hydraulic fluid makes it impossible for the hydraulic cylinder to bear a load on the boom or the like of the heavy-duty machine/vehicle which thus causes a fall of the boom.

To prevent leakage of the oil for the hydraulic cylinder when the flexible hose is damaged, it is necessary to provide a check valve or the like to the hydraulic cylinder for the prevention of such a fall.

Alternatively, instead of having the flexible hose connected to the hydraulic cylinder, a possible idea is the use of metallic piping that is less liable to damage. However, because metallic piping has no flexibility, when the hydraulic cylinders produce relative displacement in accordance with deformation or movement of the boom, distortion may possibly occur in the metallic piping connecting each hydraulic cylinder with a control valve. In particular, in the case where two hydraulic cylinders are used to drive one boom and the metallic piping connected to one control valve is divided along the way into two branches connected respectively to the hydraulic cylinders, if relative displacement between the two hydraulic cylinders occurs, the level of distortion on the metallic piping is increased and thus a crack may possibly occur.

DISCLOSURE OF THE INVENTION

It is an object of the present invention to prevent to the utmost the occurrence of stress due to distortion on metallic piping connecting a hydraulic cylinder with a control valve.

It is also an object of the present invention to inhibit action of a high degree of distortion stress on metallic piping even when the metallic piping divided into branches along the way from a single control valve is connected to, particularly, a pair of hydraulic cylinders which are apt to produce relative displacement.

The present invention provides a hydraulic cylinder apparatus that is provided with: a pair of hydraulic cylinders which are coupled to a driven member, placed parallel to each other and extend/contract in synchronization with each other; a control valve which controls hydraulic fluid supplied to or discharged from the pair of the hydraulic cylinders; an elastic support mechanism which supports the control valve to each hydraulic cylinder between the pair of the hydraulic cylinders; metallic piping which connects the control valve with each of the pair of the hydraulic cylinders and leads the hydraulic fluid controlled by the control valve; and curved portions which are provided at some midpoints of the piping and flexibly deform in accordance with relative deformation of each of the pair of the hydraulic cylinders, whereby a difference in relative displacement of each of the pair of the hydraulic cylinders with respect to the control valve is absorbed.

Accordingly, in the present invention, the control valve and the pair of the hydraulic cylinders are connected by the use of metallic piping. Hence, high resistance to high pressure is ensured. Further, even when the pair of the hydraulic cylinders follow the movement or displacement in a direction in which the driven member is twisted, and thus produce relative displacement with each other, the difference in relative displacement between each of the pair of the hydraulic cylinders and the control valve is absorbed by means of elastic deformation produced in the elastic support mechanism and also of flexible deformation produced in each curved portion of the metallic piping. Thus, it is possible to reliably prevent the metallic piping from being damaged without action of any undue force on the metallic piping.

BEST MODE FOR CARRYING OUT THE INVENTION

An embodiment according to the present invention will be described below with reference to the accompanying drawings.

Figure 1:
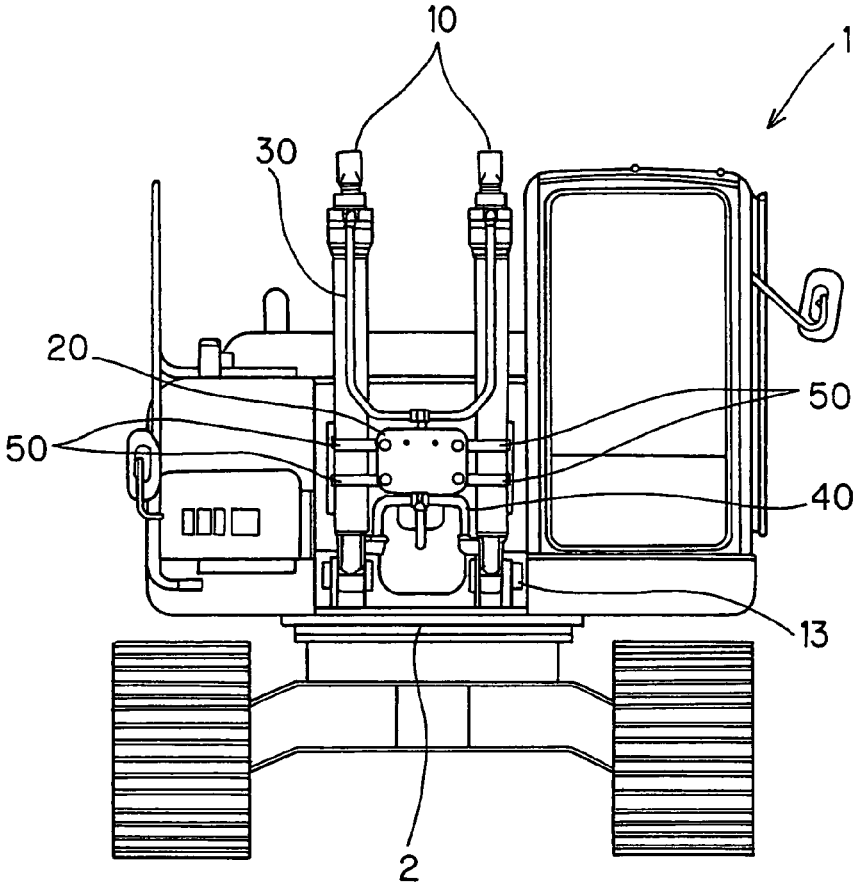
FIG. 1 is a front view of a heavy-duty machine/vehicle illustrating an embodiment of the present invention.
Figure 2:
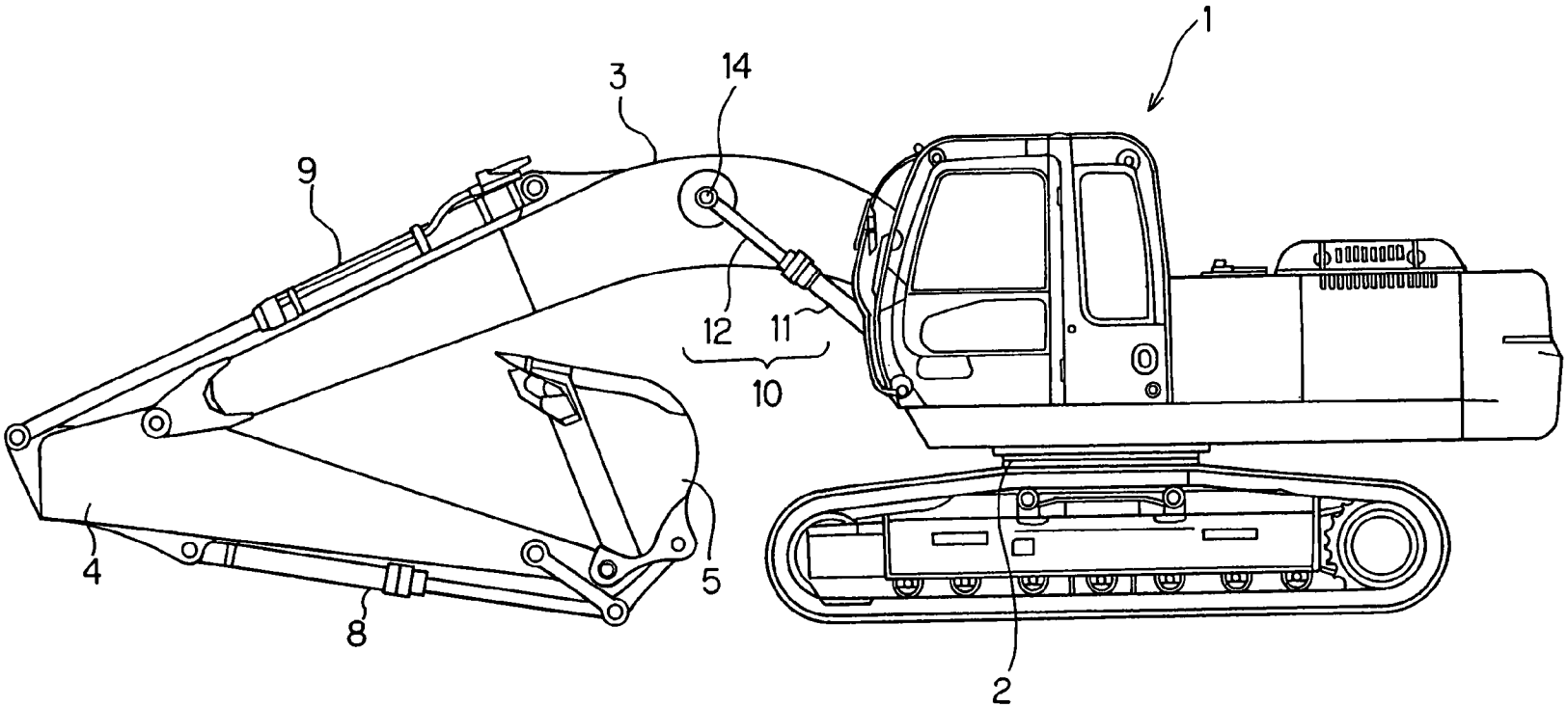
FIG. 2 is a side view of the heavy-duty machine/vehicle ditto.

As shown in FIGS. 1 and 2, a heavy-duty machine/vehicle 1 for construction includes a machine/vehicle main-body 2 that turns on a horizontal surface. A boom 3 is coupled to the front portion of the machine/vehicle main-body 2 in such a way as to be capable of being swung onto a vertical surface. A pair of hydraulic cylinders 10, which will be described in detail later, is provided for driving the boom 3. An arm 4 is coupled to the leading end of the boom 3 in such a way as to be capable of being swung, and driven by a single hydraulic cylinder 9. A bucket 5 is coupled to the leading end of the arm 4 in such a way as to be capable of being swung, and driven by a single hydraulic cylinder 8.

The machine/vehicle main-body 2 is equipped with a hydraulic pressure source unit, which is not shown in FIGS. 1 and 2. High pressure hydraulic fluid led from the hydraulic pressure source unit is supplied to each of the hydraulic cylinders 8 to 10 so as to allow the operation of extending or contracting the cylinder. An operator manipulating the machine/vehicle 1 operates the hydraulic cylinders 8 to 10 for the extension/contraction movement to move the bucket 5, the arm 4 and the boom 3 for the excavation of earth or the carrying of soil and sand.

The aforementioned paired hydraulic cylinders 10 are located on both sides of the boom 3 so as to hold it from the right and left sides. Each of the hydraulic cylinders 10 moves a piston rod 12 with respect to a cylinder tube 11 for the extension/contraction operation when hydraulic pressure is supplied to a piston which is not shown in the Figures. The base end of each cylinder tube 11 is coupled to the front portion of the machine/vehicle main-body 2 through a support shaft 13 in such a way as to be capable of being swung. The tip end of each piston rod 12 is coupled to the corresponding side of the boom 3 through a support shaft 14. Thus, the boom 3 turns upward when the hydraulic cylinder 10 extends, and turns downward when the hydraulic cylinder 10 contracts.

A control valve 20 is located between and attached to the two hydraulic cylinders 10 driving the boom 3. The hydraulic cylinders 10 are operated for extension/contraction in synchronization with each other by the hydraulic fluid which is supplied from and discharged to the hydraulic pressure source through the control valve 20.

As illustrated in FIG. 3 to FIG. 7, the control valve 20 placed between the two hydraulic cylinders 10 is mounted on a base plate 60 provided between the cylinder tubes 11, in a position below the boom 3.

The base plate 60 is supported by being coupled to both the hydraulic tubes 11 via four elastic support mechanisms 50 which are located on the four corners thereof.

Figure 8:
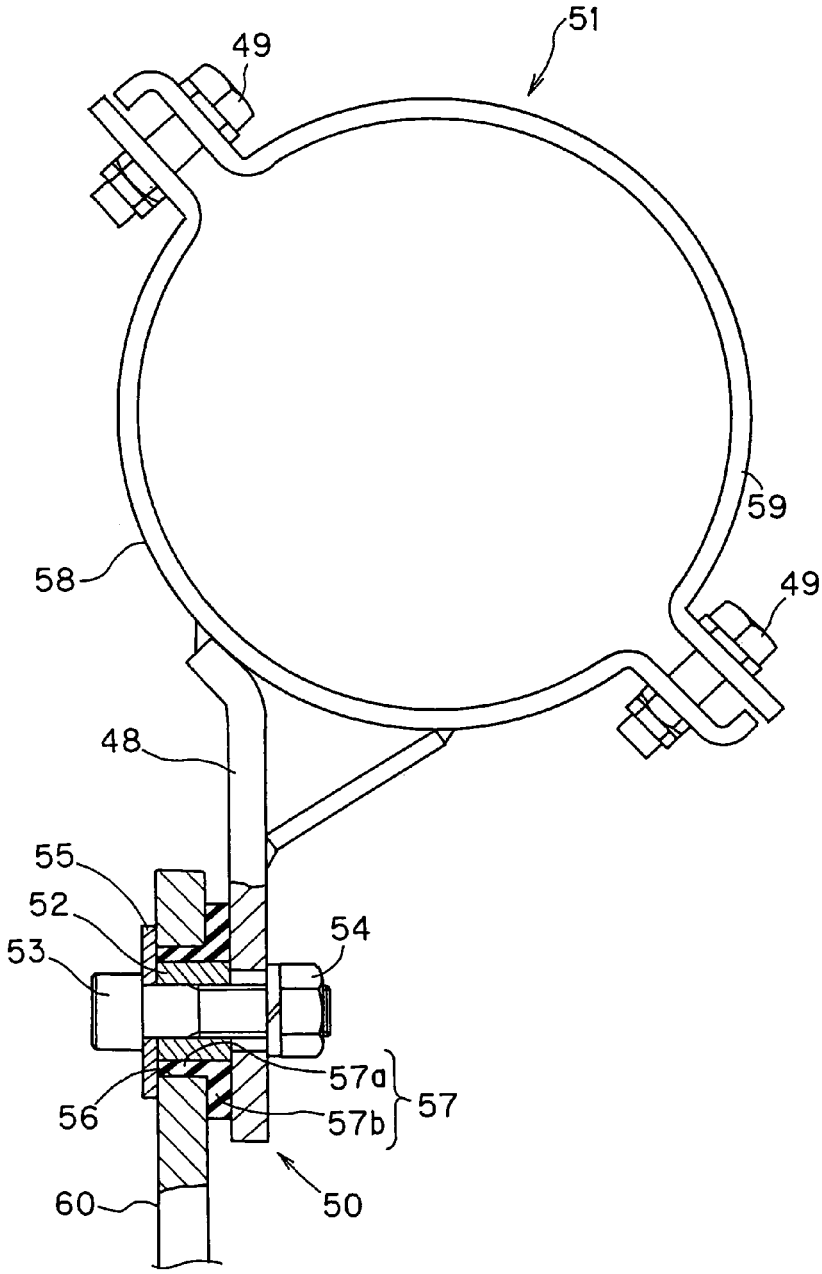
FIG. 8 is a sectional view of an elastic support mechanism ditto.

First, the elastic support mechanism 50 will be described. As illustrated in FIG. 8, the elastic support mechanism 50 includes: a band 51 that is wound around the cylinder tube 11 of the hydraulic cylinder 10; a sleeve 52 and a washer 55 that are tightly secured via a bolt 53 and a nut 54 to the band 51; a hole 56 formed in the base plate 60 for the sleeve 52 passing through there; and a bush 57 that is made of an elastic material such as rubber and interposed between the sleeve 52 and the base plate 60.

The band 51 includes a pair of semi-ring-shaped band members 58 and 59, and a pair of bolts 49 for securely fastening respective ends of the band members 58 and 59 together. The band 51 is detachably wound on the outer peripheral face of the cylinder tube 11 of the hydraulic cylinder 10. The band member 58 is welded to a support arm 48. The bolt 53 is inserted into the support arm 48.

The bush 57 has a cylindrical-shaped tube portion 57*a* interposed between the sleeve 52 and the hole 56, and a disc-shaped flange portion 57*b* interposed between the support member 48 and the base plate 60. The tube portion 57*a* and the flange portion 57*b* are formed in one piece of elastic material such as rubber. Thereby, if relative displacement is produced between the two hydraulic cylinders 10, the displacement is absorbed so as to prevent deformation of the base plate 60.

The base plate 60 is attached to a rear face 60*b* which is a reverse side of the base plate 60 in the front-rear direction of the vehicle body. The base plate 60 serves the function of a protective member for preventing the control valve 20 from suffering the impact of an obstruction.

The control valve 20 and the pair of hydraulic cylinders 10 are connected through metallic piping 30 and 40. The metallic piping 30 and the metallic piping 40 have a piping strength higher than that of a flexible hose or the like, and adequate resistance to high pressure.

Figure 3:
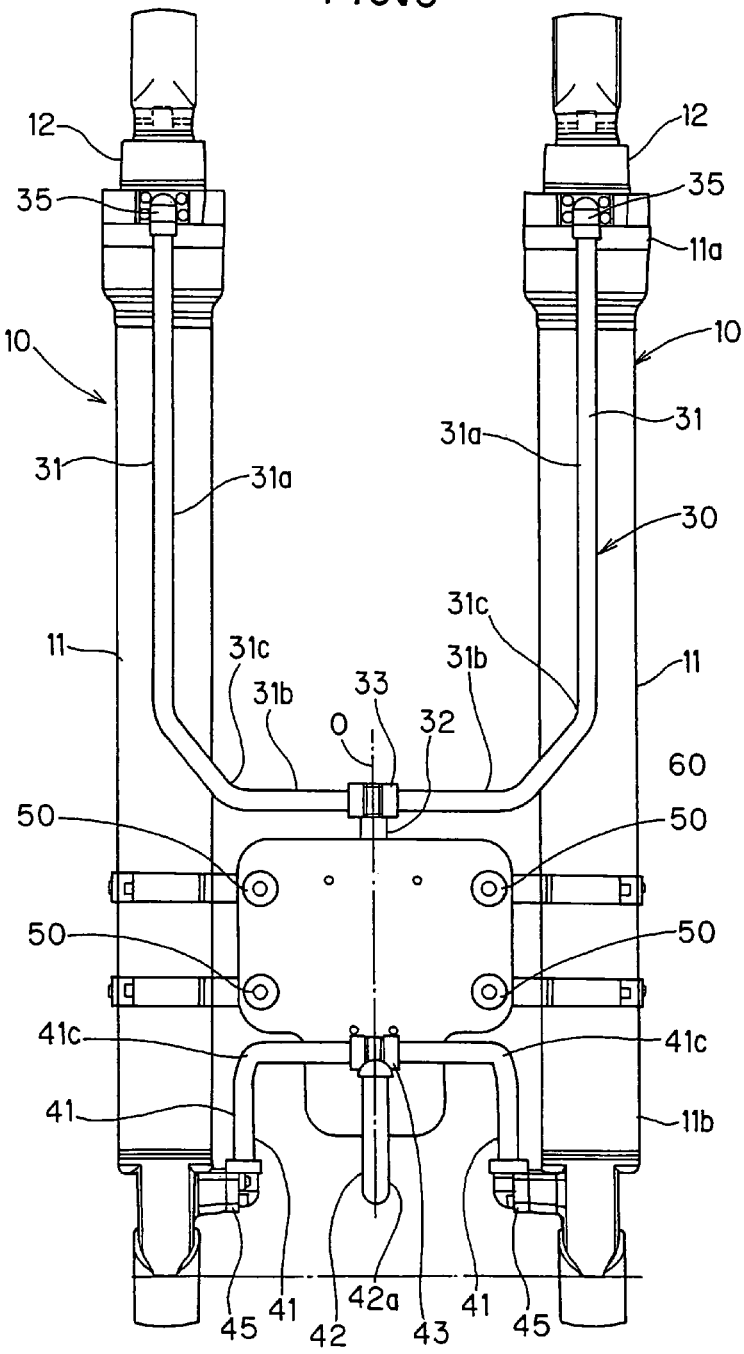
FIG. 3 is a front view of a pair of hydraulic cylinder apparatuses ditto.
Figure 4:
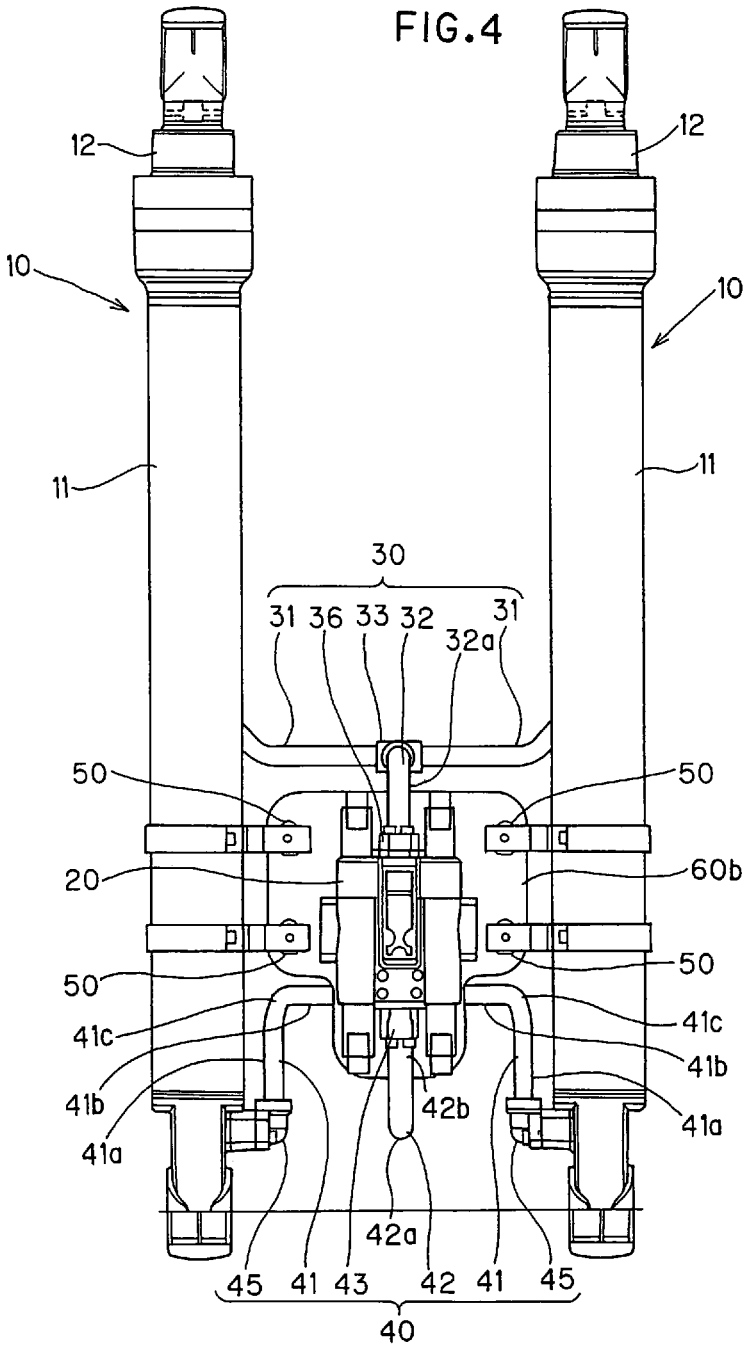
FIG. 4 is a rear view of the hydraulic cylinder apparatuses ditto.
Figure 5:
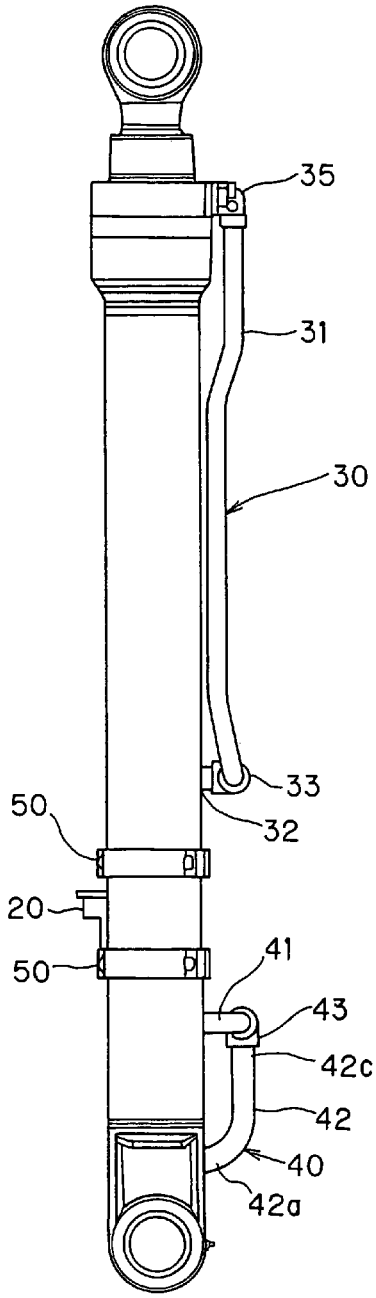
FIG. 5 is a side view of the hydraulic cylinder apparatus ditto.
Figure 6:
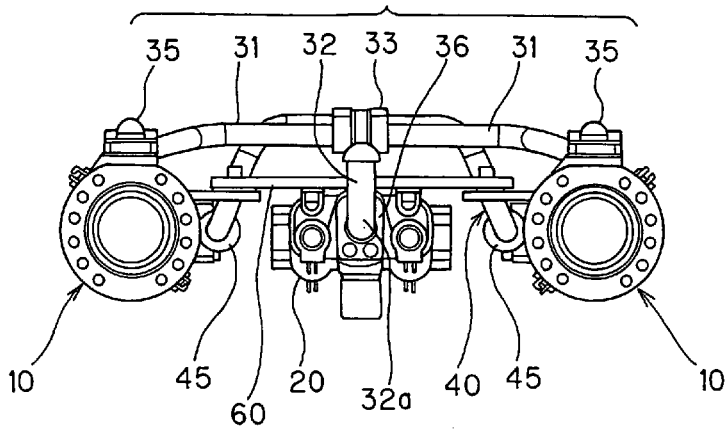
FIG. 6 is a plan view of the hydraulic cylinder apparatuses ditto when viewed from above.
Figure 7:
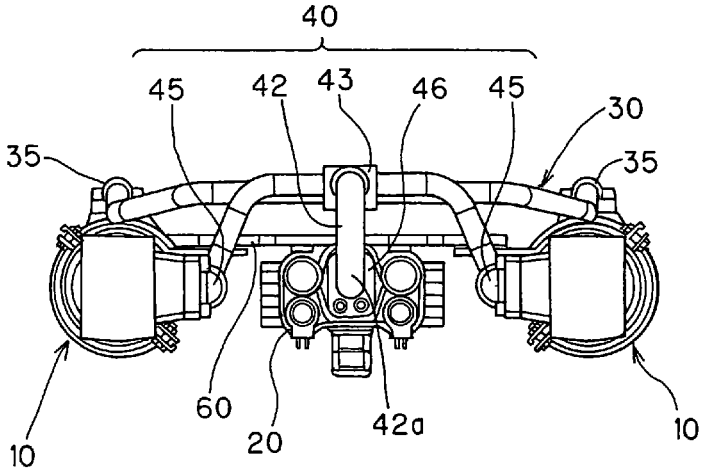
FIG. 7 is a plan view of the hydraulic cylinder apparatuses ditto when viewed from below.

With the control valve 20 as the center, the metallic piping 30 and the metallic piping 40 are in symmetrical formation with respect to the center line Q between the paired hydraulic cylinders 10 as shown in FIG. 3. Thereby, the hydraulic fluid flows equally from the control valve 20 to each of the hydraulic cylinders 10 to allow the hydraulic cylinders 10 to be operated in synchronization with each other.

The metallic piping 30 is provided for forming a connection between the control valve 20 and the hydraulic chamber of the piston rod of each hydraulic cylinder 10. The metallic piping 30 includes a single base pipe 32 connected via a connector 36 to the control valve 20, two L-shaped branch pipes 31 each connected via a connector 35 to the leading end of each cylinder tube 11, and a T-shaped connector 33 for connecting the base pipe 32 with the branch pipes 31.

The base pipe 32 extents such that the two ends thereof respectively connected to the connectors 33 and 36 are at right angles to each other to provide a curved portion 32*a* between the ends. The curved portion 32*a* flexibly deforms, whereby the difference in relative displacement of the base plate 60 with respect to each hydraulic cylinder 10 is absorbed.

Each of the L-shaped branch pipes 31 is composed of a pipe 31*a* extending along the cylinder tube 11, a pipe 31*b* extending at right angles to the cylinder tube 11, and a curved portion 31*c* connecting the pipe 31*a* and the pipe 31*b*. The curved portion 31*c* flexibly deforms, whereby the difference in relative displacement of each hydraulic cylinder 10 is absorbed.

In this connection, the curved portion 32*a* of the base pipe 32 and the curved portion 31*c* of the branch pipe 31 are both curved within an approximate right angle range and also on the surfaces forming right angles with each other. As a result of the foregoing, the absorption of distortion in three dimensional directions is achieved.

The metallic piping 4*b* is provided for forming a connection between the control valve 20 and the hydraulic chamber in the end of each hydraulic cylinder 10. The metallic piping 40 includes a single U-shaped base pipe 42 connected via a connector 46 to the control valve 20, two L-shaped branch pipes 41 each connected via a connector 45 to the base end of each cylinder tube 11, and a T-shaped connector 43 provided for connecting the base pipe 42 with the branch pipes 41.

The base pipe 42 has two ends 42*b* and 42*c* respectively connected to the connectors 43 and 46, and a curved portion 42*a* forming a connection between the ends 42*b* and 42*c*. In this case, the ends 42*b* and 42*c* of the U-shaped base pipe 42 extend parallel to each other on both sides of the base plate 60 so that the curved portion 42*a* is curved in an arc shape to form a U shape around the end of the base plate 60. The curbed portion 42*a* flexibly deforms, whereby the difference in relative displacement of the base plate 60 with respect to each hydraulic cylinder 10 is absorbed.

The branch pipe 41 is composed of a pipe 41*a* extending along the cylinder tube 11, a pipe 41*b* extending at right angles to the cylinder tube 11, and a curved portion 41*c* connecting the pipe 41*a* and the pipe 41*b*. The curved portion 41*c* flexibly deforms, whereby the difference in relative displacement of each hydraulic cylinder 10 is absorbed.

In this case, the curved portion 42*a* of the base pipe 42 and the curved portion 41*c* of the branch pipe 41 are also curved on the surfaces at right angles to each other. Thereby, absorption of distortion in three dimensional directions is achieved.

The control valve 20 is located closer to the end-side end 11*b* of each cylinder tube 11 than the piston-rod-side end 11*a* thereof. The portion of the metallic piping 30 close to the piston rod of the cylinder tube 11 is longer in pipe length than the portion of the metallic piping 40 close to the end of the cylinder tube 11.

Figure 9:
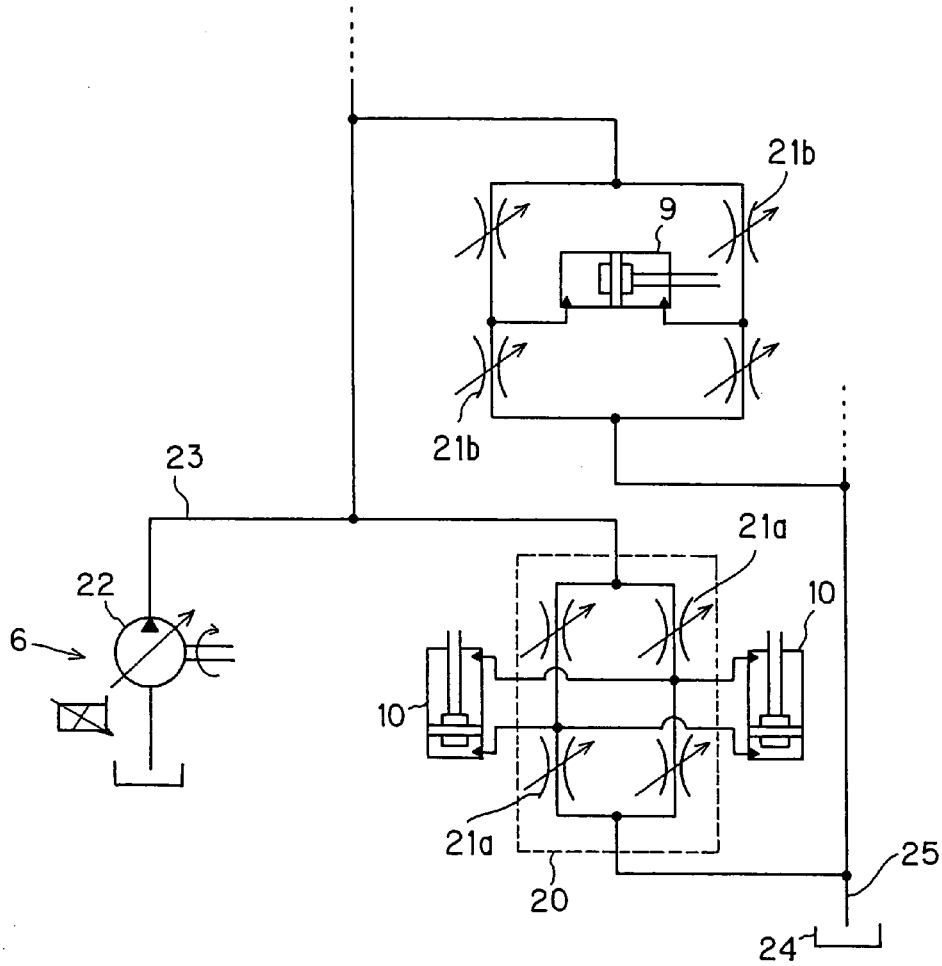
FIG. 9 is a hydraulic circuit diagram ditto.

As illustrated in the hydraulic circuit in FIG. 9, the control valve 20 includes four flow control valves 21*a* connected in a bridge circuit. A supply passage 23 and a return passage 25 are connected selectively to each of the hydraulic chambers of the pair of hydraulic cylinders 10 for extension/contraction operation of the hydraulic cylinders 10. The supply passage 23 intercommunicates with a hydraulic pump 22', and the return passage 25 intercommunicates with a reservoir 24.

Likewise, the hydraulic cylinder 9 for driving the arm 4 is equipped with a control valve including four flow control valves 21*b*.

In the control valve 20, the degree of valve opening of each of the flow control valves 21*a* is controlled by a drive current sent from a control unit which is not shown in the Figures. Through this control, the amount of the hydraulic fluid supplied to or discharged from each of the hydraulic chambers of the hydraulic cylinders 10 is controlled to thereby adjust the speed of extension or contraction of the hydraulic cylinders 10. If each of the flow control valves 21*a* is fully closed or if the flow control valve that is connected to the hydraulic chamber of the hydraulic cylinder 10 under load is fully closed, outflow of the hydraulic fluid from the hydraulic cylinder 10 can be stopped to prevent the falling of the boom 3 due to the load.

In this case, out of the metallic piping 30 and the metallic piping 40 which connect the control valve 20 and the hydraulic cylinders 10, high pressure acts specially on the metallic piping 40. However, it is still possible for the metallic piping 40 to provide adequate resistance to pressure, unlike the case of a flexible tube.

In the foregoing structure, the operation will be described next.

The control valve 20 switches between supply and discharge of the hydraulic fluid to and from each hydraulic cylinder 10 to allow the hydraulic cylinders 10 to extend/contract in synchronization with each other, and also the control valve 20 serves the function as an emergency shutoff valve for holding the boom 3 in a lifted position to prevent its falling by means of stopping the outflow of the hydraulic fluid from the hydraulic cylinders 10.

The metallic piping 30 and the metallic piping 40 are used for forming a hydraulic pressure passage connecting the control valve 20 and each of the hydraulic chambers of the pair of hydraulic cylinders 10, thereby making it possible to ensure adequate strength to withstand high pressure.

However, since the metallic piping 30 and the metallic piping 40 have no elasticity as a flexible tube does, the metallic piping has a low capability of absorbing stress caused by deformation or distortion. In particular, the two hydraulic cylinders 10 driving the boom 3 produce relative displacement following the deformation or movement in the direction in which the boom 3 is twisted. Hence, distortion occurs in the metallic piping 30 and the metallic piping 40 connecting the control valve and each hydraulic cylinder 10. However, the difference in the relative displacement of the control valve 20 with respect to each hydraulic cylinder 10 is absorbed by elastic deformation of the bush 57 of each elastic support mechanism 50, and also by flexible deformation of the curved portions 31*c* and 32*a* of the metallic piping 30 on the surfaces at right angles to each other and flexible deformation of the curved portions 41*c* and 42*a* of the metallic piping 40 on the surfaces at right angles to each other. Thus, it is possible to prevent damage caused by distortion without the application of any undue force to the metallic piping 30 and the metallic piping 40.

Because the metallic piping 40 has the curved portion 42*a* of the base pipe 42 semi-circularly curving around the base plate 60, the metallic piping 40 has a large amount of flexible deformability. Hence, the difference in relative displacement of the base plate 60 with respect to each hydraulic cylinder 10 is satisfactorily absorbed to make it possible to prevent breakage of the piping.

The relative displacement caused following the deformation or movement of the boom 3 is larger at the rod-side end 11*a* of the cylinder tube 11 located close to the boom than that at the end-side end 11*b*. Regardless of the large relative displacement, however, the warp angle occurring on the piping 30 is small and also the stress produced is low. This is because the control valve 20 is located closer to the end-side end 11*b* of each cylinder tube 11 than the rod-side end 11*a*, so that the metallic piping 30 is greater in pipe length than the metallic piping 40.

It is obvious that the present invention is not limited to the foregoing embodiment, and various changes can be made within the scope of the technical idea. For example, the control valve 20 is mounted on the base plate 60, but the control valve 20 can be supported directly by the elastic support mechanism 51.

INDUSTRIAL APPLICABILITY

The present invention is applicable as a hydraulic cylinder apparatus for industrial machinery.

The invention claimed is:

1. A hydraulic cylinder apparatus, comprising:

a pair of hydraulic cylinders that are coupled to a driven member, are placed parallel to each other, and extent/contract in synchronization with each other;

a control valve that controls supply/discharge of hydraulic fluid from/to the pair of the hydraulic cylinders;

an elastic support mechanism that supports the control valve to each of the pair of the hydraulic cylinders between the pair of the hydraulic cylinders;

metallic piping that connects the control valve and each of the pair of the hydraulic cylinders and leads hydraulic fluid controlled by the control valve; and curved portions that are provided at some midpoints of the metallic piping and flexibly deform in accordance with relative displacement of each of the pair of the hydraulic cylinders, wherein:

a difference in the relative displacement of each of the pair of the hydraulic cylinders with respect to the control valve is absorbed.

2. The hydraulic cylinder apparatus according to claim 1, wherein:

the pair of the hydraulic cylinders are located on both sides of the driven member, and the control valve and the metallic piping are placed symmetrically with respect to a center line between the pair of the hydraulic cylinders.

3. The hydraulic cylinder apparatus according to claim 2, further comprising:

a base plate on which the control valve is mounted, wherein:

the base plate is placed between the pair of the hydraulic cylinders and is coupled to each of the pair of the hydraulic cylinders through the elastic support mechanism provided on both sides of the base plate.

4. The hydraulic cylinder apparatus according to claim 3, wherein:

the control valve is mounted on a face of the base plate opposite to the driven member.

5. The hydraulic cylinder apparatus according to claim 3, wherein:

the metallic piping includes piping connected to one of hydraulic pressure chambers of the pair of the hydraulic cylinders and piping connected to the other of the hydraulic pressure chambers of the pair of the hydraulic cylinders, wherein:

in each piping, the curved portions are curved within an approximate right angle range on surfaces forming right angles with each other.

6. The hydraulic cylinder apparatus according to claim 5, wherein:

the metallic piping is formed by connecting a single pipe connected to the control valve and a pair of branch pipes which are connected respectively to the pair of the hydraulic cylinders, and the curved portion provided in the single pipe and the curved portion provided in each of the branch pipes are located on surfaces at right angles to each other.

7. The hydraulic cylinder apparatus according to claim 6, wherein:

the single pipe includes the curved portion curving in a U shape, and is connected respectively to the pair of the branch pipes on the rear face of the control valve.

* * * * *